US008398192B2

(12) United States Patent
Hartung

(10) Patent No.: US 8,398,192 B2
(45) Date of Patent: Mar. 19, 2013

(54) INK-SAVING INK SUPPLY OF PRINTING MACHINES

(75) Inventor: Thomas Hartung, Augsburg (DE)

(73) Assignee: Technotrans AG, Sassenberg (DE)

( * ) Notice: Subject to any disclaimer, the term of this patent is extended or adjusted under 35 U.S.C. 154(b) by 198 days.

(21) Appl. No.: 12/918,879

(22) PCT Filed: Feb. 23, 2009

(86) PCT No.: PCT/EP2009/001274

§ 371 (c)(1),
(2), (4) Date: Sep. 7, 2010

(87) PCT Pub. No.: WO2009/106281

PCT Pub. Date: Sep. 3, 2009

(65) Prior Publication Data

US 2011/0001774 A1 Jan. 6, 2011

(30) Foreign Application Priority Data

Feb. 25, 2008 (DE) ..... 10 2008 011 007

(51) Int. Cl.
*B41J 2/195* (2006.01)

(52) U.S. Cl. ..... 347/7; 347/84

(58) Field of Classification Search ..... 347/5–7, 347/84–86

See application file for complete search history.

(56) References Cited

U.S. PATENT DOCUMENTS

2006/0132554 A1* 6/2006 Ota et al. ..... 347/85

FOREIGN PATENT DOCUMENTS

| | | | |
|---|---|---|---|
| DE | 19515621 | A1 | 10/1996 |
| DE | 19859436 | A1 | 6/2000 |
| DE | 19953324 | A1 | 5/2001 |
| DE | 10246946 | A1 | 5/2003 |
| DE | 10236780 | C1 | 9/2003 |
| DE | 10305918 | A1 | 10/2003 |
| DE | 202007006450 | U1 | 8/2007 |
| DE | 102007020678 | A1 | 12/2007 |
| DE | 102007044216 | A1 | 4/2008 |
| EP | 0958920 | A1 | 11/1999 |
| EP | 1389523 | A1 | 2/2004 |
| WO | 03045695 | A1 | 6/2003 |

OTHER PUBLICATIONS

Machine English Translation of description of DE202007006450.*
Machine English Translation of description of EP0958920.*

* cited by examiner

*Primary Examiner* — Julian Huffman
*Assistant Examiner* — Sharon A Polk
(74) *Attorney, Agent, or Firm* — Richard M. Goldberg

(57) ABSTRACT

An ink delivery device (30) for the ink supply of an inking system (20) of a printing machine (10) with ink, includes an ink reservoir (31), a drive that is connected to the ink reservoir (31) and configured such that the ink reservoir (31) can be pressurized by the drive, and a control device for controlling the drive of the ink delivery device (30), in which the drive and the control device are configured and connected with each other such that the ink delivery device (30) can be operated based on a method, in which the method includes the following steps: initiating an ink delivery process, increasing the pressure in the ink reservoir to a target operating pressure, adjusting the pressure in the ink reservoir to an adjusted operating pressure, and terminating the ink delivery process.

14 Claims, 1 Drawing Sheet

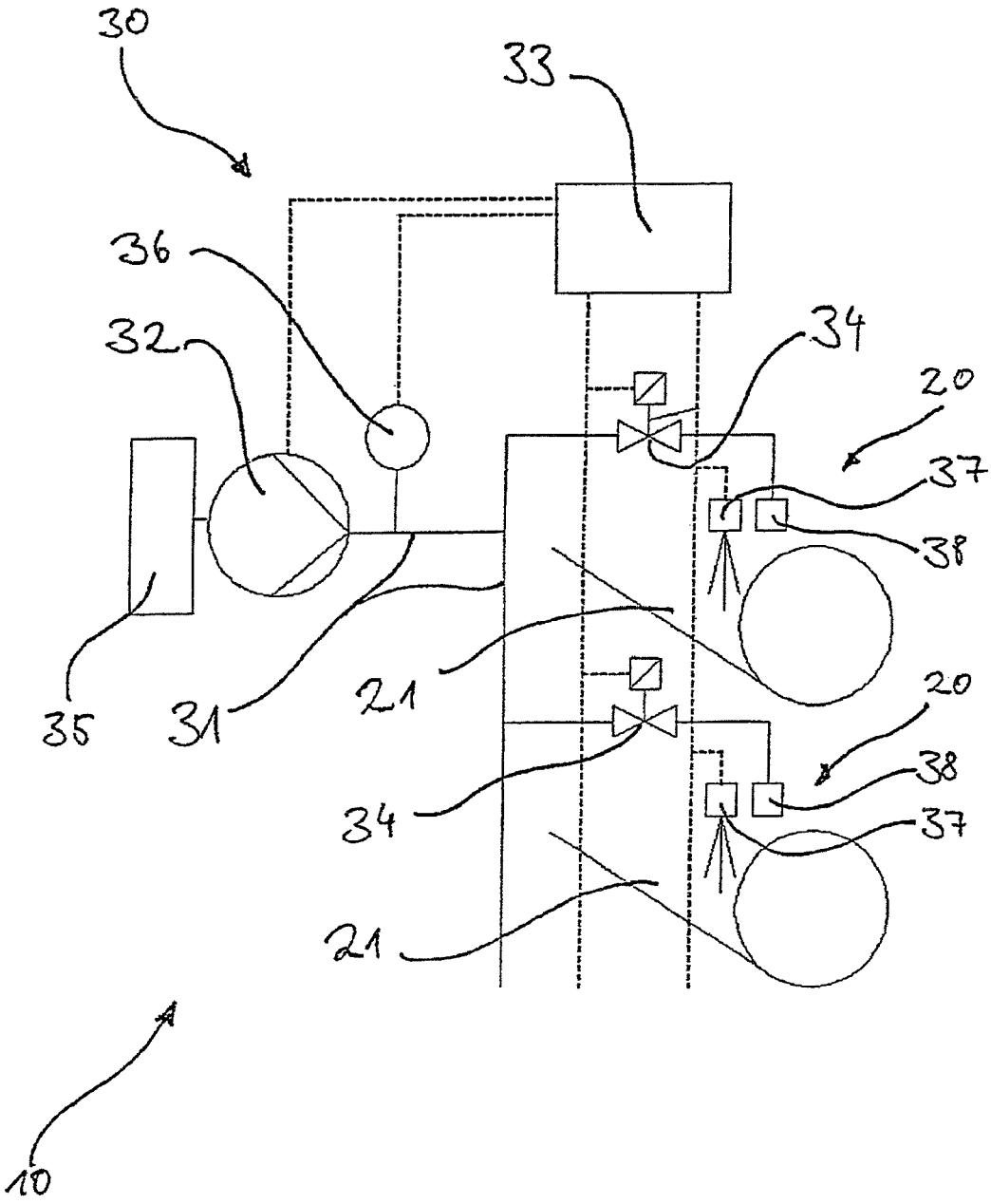
30
33
36
32
34
20
37
38
35
31
21
20
38
34
37
21
10

INK-SAVING INK SUPPLY OF PRINTING MACHINES

FIELD OF THE INVENTION

The invention relates to an ink-saving ink supply of printing machines.

BACKGROUND OF THE INVENTION AND PRIOR ART

Printing machines have to be supplied with ink during operation. In particular in offset printing machines, inking systems which take ink off an ink fountain and transfer it to the impression cylinder(s) are provided for this purpose. Sometimes, it is necessary to refill ink in these ink fountains depending on the consumption.

For this purpose, various devices are known which show different solution approaches.

In offset supplies, ink is sometimes delivered into the ink fountains via a pipe system.

To this end, usually double-action piston pumps are used, which build up pressure in the pipe system. The control of the ink fountain filling is performed via the actuation of an ink valve, which opens as required and closes at the end of the filling process. The piston pump continues delivering during the filling process.

Moreover, ink supply systems, such as DE 199 53 324 A1, are known in which the ink feed is effected via ink cartridges. A further ink supply device of that type is disclosed in DE 10 2004 001 751 A1.

OBJECT

It is an object of the invention to provide a versatile method for use with an ink delivery device, as well as such an ink delivery device, which can be employed in conjunction with various printing machines and printing materials.

Solution to the Object

The object is solved by the method and the device according to the independent claims. Advantageous embodiments are disclosed in the subclaims.

A first aspect of the invention relates to a method for use with an ink delivery device for the ink supply of an inking system of a printing machine with ink, comprising an ink reservoir, a drive that is connected to the ink reservoir and configured such that the ink reservoir can be pressurized by means of the drive, and a control device for controlling the drive of the ink delivery device, wherein the method comprises the following steps:

- initiating an ink delivery process,
- increasing the pressure in the ink reservoir to a target operating pressure,
- adjusting the pressure in the ink reservoir to an adjusted operating pressure, and
- terminating the ink delivery process.

Surprisingly, it has turned out that in some ink supplies, in which a pressure is built up and maintained in an ink-containing pipe system for delivering ink, the mechanical stress has a negative influence on the ink due to the pressure permanently acting on the ink. For example, in particular in the case of UV ink, undesired reactions, such as hardening or solidifying of the ink may occur. These effects are eliminated or at least reduced by the method according to the invention, so that the method according to the invention can be employed with various printing machines using different printing materials, such as the printing ink. According to the invention, the pressure-increasing step may be performed simultaneously with, before or after the initiation step, and the terminating step may be performed simultaneously with, before or after the step of reducing the pressure in the ink reservoir. The ink reservoir may comprise a volume of a piping system, which extends e.g. between a pump and one or more ink valve(s) and connects an ink container in an ink fountain or several ink fountains of an inking system or several inking systems. The ink reservoir may also comprise a volume of an ink cartridge in which an ink volume can be pressurized e.g. via a piston. Other construction forms are conceivable as well. The target operating pressure preferably is a pressure at which a desired, delivered ink flow, i.e. a desired, delivered ink quantity (weight or volume) per unit time adjusts. The target operating pressure may be variable over a delivery time, so that the delivered ink flow can be adjusted to various parameters. Such parameters may be: the ink level in the ink fountain, in particular different level in different regions of the ink fountain, the type of ink used (viscosity, printing stability, hardening behavior under pressure, etc.), a number of opened ink valves, a total ink flow to be delivered, etc.

Further preferred is a method in which the pressure-increasing step comprises the following steps:

- detecting an actual pressure in the ink reservoir,
- comparing the detected actual pressure with a target operating pressure;
- controlling the drive based on the comparative value between actual pressure and target operating pressure such that the drive power of the drive is increased.

An example for increasing the drive power of the drive of the delivery device is the switching-on or connecting-up of the drive, i.e. the increasing of a delivery power from zero to a value above zero. Such a drive may be an ink pump, such as a screw spindle pump driven via a frequency-controlled three-phase motor. Such a pump may pump the ink from an ink container into the ink reservoir, for example. Furthermore, the drive may be an electric motor, which operates a piston in the ink reservoir via a screw drive, for example. It is also conceivable that the drive is formed by a compressor, which pressurizes a piston in the ink reservoir on a side opposite to the ink with a target operating pressure. In such a gas-operated delivery device, the drive may also be provided by a pressure tank, e.g. a compression container, which may be connected with the ink-opposite side of the piston in the ink reservoir via a valve. Furthermore, any other kind of drive enabling a delivery of the ink is conceivable. The drive power can be increased in a targeted manner such that the actual pressure reaches the target operating pressure and thus the delivery power is increased to a target level.

A further advantageous embodiment relates to a method in which the method further comprises the following step:

- maintaining the pressure in the ink reservoir at the target operating pressure.

Preferably, such a method has a configuration according to which the step of maintaining the pressure comprises the following steps:

- detecting an actual pressure in the ink reservoir,
- comparing the detected actual pressure with the target operating pressure,
- controlling the ink delivery device based on the comparative value between the actual pressure and the target operating pressure such that the drive power is kept constant if the actual pressure corresponds to the target operating pressure, and/or that the drive power is reduced if the actual pressure exceeds the target operating pressure, and/or that the drive power is increased if the actual pressure is below the target operating pressure.

Here, a target operating pressure may be defined as a range between a target operating pressure upper value and a target operating pressure lower value. Maintaining the pressure has the advantage that also in the case of a change between differently large, delivered ink flows, e.g. if a different number of ink valves is opened in an ink delivery device with several ink valves, a desired operating pressure is not exceeded. In an ink delivery device having an ink pump (e.g. a screw spindle pump) controlled via the output pressure, which is driven via a three-phase motor, an increase and/or a reduction of the drive power may occur via a change of the supply frequency. An example of reducing the drive power comprises, in addition to a mere decrease, also reducing the drive power to zero (switching-off of the drive). Also, increasing the drive power comprises switching-on the drive of the delivery device. Thereby, a pulsed controlled of the pressure level can take place.

Further preferred is such a method in which the step of adjusting the pressure in the ink reservoir (31) to an adjusted operating pressure comprises the following steps:

detecting an actual pressure in the ink reservoir (31), comparing the detected actual pressure with a varied target operating pressure;

controlling the ink delivery device (30) based on the comparative value between the actual pressure and the varied target operating pressure such that the drive power of the drive is reduced.

A further advantageous variation relates to such a method in which the step of adjusting the pressure in the ink reservoir (31) to an adjusted operating pressure comprises reducing the pressure to an idle pressure.

This has the advantage that the pressure acting on the ink in the ink reservoir at times where the ink delivery device is at rest, i.e. does not deliver ink, is reduced to a minimum pressure. In this connection, it has surprisingly turned out that not only the pressure peaks have a negative influence on certain inks, but also the duration during which a pressure acts on the ink. Therefore, the ink is only subjected to a minimum mechanical stress and is thus saved to a particularly large extent. Such a minimum pressure may be the atmospheric pressure, i.e. the ambient pressure.

Further preferred is an embodiment of the method in which the step of reducing the pressure to an idle pressure comprises one or more of the following steps:

reversing the delivery direction of the ink delivery device, and/or opening an ink valve.

If the delivery device comprises a pump, reversing of the delivery direction may be performed by pumping backward. By such a control, the pressure can be reduced to an advantageous, particularly ink-saving minimum pressure, as already illustrated. Such a pressure can be adjusted in an arbitrary manner. Preferably, the pressure is adjusted such that it is slightly above the level of the atmospheric ambient pressure, more preferably approximately at the level of the atmospheric ambient pressure, or even below the level of the atmospheric ambient pressure. A simple sequence of method steps, which leads to a desired reduction of the pressure to the idle pressure, may be that at first the ink valve is closed in order to interrupt the ink delivery process in a defined manner. This may be preceded by a switch-off of the drive in order to not create an unnecessary high pressure after closing of the valve. Subsequently, the drive may reverse to further reduce the pressure. Finally, in the state of rest, the ink valve can be opened to achieve a pressure equalization with the ambient pressure. This is particularly advantageous if an ink with a suitable viscosity is used, which prevents ink from flowing out. In the case of several ink valves, only one ink valve can be opened.

Furthermore, such a method preferably has an embodiment in which the step of reducing the pressure to an idle pressure comprises one or more of the following steps:

Furthermore, such a method preferably has an embodiment in which the step of reducing the pressure to a idle pressure comprises one or more of the following steps:

stopping or disengaging the drive of the ink delivery device, and/or connecting the ink reservoir with a space in which the target idle pressure prevails, and/or opening an ink valve.

Connecting the ink reservoir with a space in which the target idle pressure prevails comprises Connecting an ink-opposite side of a pressure-actuated piston in the ink reservoir with an ambient pressure. This variant is advantageous, for example, if ink cartridges are used in which the ink is increased via an increase of a pressure in a volume adjacent to the ink in the ink reservoir. The pressure in the adjacent volume may be transferred to the ink in the ink reservoir via a piston. In such a device, the drive of the ink delivery device may have a compressor and/or a pressure tank, which provides the target operating pressure in the adjacent volume. According to the preferred method, it can be switched off or a pressure tank can be separated from the adjacent volume via a valve. The adjacent volume may be connected with the atmospheric ambient pressure or with a blow-down tank e.g. by opening a valve. In devices, which have one or more actuatable ink valves, connecting of the ink reservoir with a space in which the target idle pressure prevails may comprise leaving open one or more of the ink valves, which allow ink to exit from the ink reservoir into the ink fountain of an inking system and thus provide a connection between the ink reservoir and the ambient air.

Further preferred is a method in which the step of initiating an ink delivery process comprises the following step:

opening an ink valve.

In the present application, the term ink valve designates a valve that allows ink to exit from the ink reservoir into the ink fountain of an inking system. One or more such ink valves may be provided on a movable ink cartridge or in a stationary manner on so-called ink guide tubes arranged on an inking system such that various regions of an ink fountain can be supplied with ink.

A further advantageous embodiment relates to a method in which the step of terminating the ink delivery process comprises the following step:

closing an ink valve.

Preferably, such a method has a configuration according to which the method further comprises the following steps:

detecting an actual ink level, comparing the detected actual ink level with a target ink level, initiating the ink delivery process if the detected actual ink level is below the target ink level, and/or increasing the pressure in the ink reservoir to a target operating pressure if the detected actual ink level is below the target ink level.

Further preferred is a method in which the method comprises the following steps:

detecting an actual ink level, comparing the detected ink level with a target ink level, terminating the ink delivery process if the detected actual ink level exceeds the target ink level, and/or reducing the pressure in the ink reservoir to an idle pressure if the detected actual ink level exceeds the target ink level.

A further advantageous variation relates to such a method in which the method further comprises the following step:

determining the target operating pressure and/or the adjusted operating pressure.

Further preferred is an embodiment of the method in which the step of determining the target operating pressure and/or the adjusted operating pressure comprises the following steps:

detecting the ink level in an ink fountain (21), in particular different levels in different regions of an ink fountain (21), and/or determining the type of ink used and the properties thereof, in particular its viscosity and/or printing stability and/or hardening behavior under pressure, /or determining the maximally admissible pressure depending on the determined type of ink used, and/or detecting the number of opened ink valves (34), determining the total ink flow to be delivered, and/or determining the time available for one delivery process, and/or calculating the target operating pressure based on one or more of the above-mentioned values.

The step of determining the type of ink used can be performed by a user input of the ink type and by storing the parameters in the control unit. It is also conceivable that the ink type is detected e.g. by suitable sensors in an automatic or semi-automatic manner and/or is stored. The step of determining the total ink flow to be delivered, i.e. the total volume per unit time, can be performed depending on the number of opened valves.

A second aspect of the invention relates to an ink delivery device for the ink supply of an inking system of a printing machine with ink, comprising an ink reservoir, a drive that is connected to the ink reservoir and configured such that the ink reservoir can be pressurized by means of the drive, and a control device for controlling the drive of the ink delivery device, wherein the drive and the control device are configured and connected with each other such that the ink delivery device can be operated based on one of the above methods.

Further preferred embodiments of the ink delivery device arise from the features of the subject matter, which arise from the description of the above methods and/or the following description of the FIGURE.

In the following, individual particularly preferred embodiments of the invention will be described by way of example. The individual described embodiments partly have features that are not absolutely imperative for realising the present invention, but that generally are advantageous. Thus, embodiments, which do not include all features of the embodiments described in the following, are to be considered to be disclosed as falling under the teaching of the invention as well. It is also conceivable to selectively combine features described with respect to different embodiments.

BRIEF DESCRIPTION OF THE DRAWING

FIG. 1 shows a preferred embodiment of a device according to the invention.

DETAILED DESCRIPTION OF THE DRAWING

FIG. 1 shows a preferred embodiment of an ink delivery device 30 according to the invention. In the illustrated embodiment, the ink delivery device 30 is arranged on a printing machine 10, of which only a part is shown in FIG. 1. The ink delivery device 30 may also be arranged on several printing machines 10 and supply them with ink.

Parts of two inking systems 20 are shown, wherein the ink delivery device 30 supplies both illustrated inking systems 20 with ink. It is also conceivable that the ink delivery device 30 only supplies one inking system 20 or more than the illustrated two inking systems 20 with ink.

The ink delivery device 30 has a drive 32, a control device 33, and ink valves 34. In the preferred embodiment, the drive 32 is formed as a screw spindle pump that can be driven via a three-phase motor. A revolution speed of the pump can be adjusted via the frequency of the three-phase AC, with which the three-phase motor is supplied, so that the pump performance can be adjusted via the revolution speed.

An ink reservoir 31 is formed between the drive 32 and the ink valves 34. In the illustrated embodiment, the ink reservoir 31 is thus formed by a piping system. In the preferred embodiment, the term ink reservoir 31 therefore designates the volume enclosed between the pump and the ink valves. Depending on the arrangement of the drive 32 and its assignment to one or more inking systems with one or more ink valves 34 each, such a piping system may be formed in a strongly branched manner, wherein the individual pipe sections between the pump and the individual ink valves 32 may have different diameters and lengths.

In the illustrated embodiment, an ink delivery pipe 38 extends in the flow direction of the ink in the piping system behind the respective ink valves 34, said ink delivery pipe feeding the delivered ink into the ink fountains 21 of the inking systems 20 in a targeted manner. It is also conceivable that the ink valves 34 are attached at the end of the pipes, so that no ink delivery pipes 38 are provided behind the ink valves 34.

In the illustrated embodiment, the pump pumps ink from an ink container 35 into the ink fountains 21 through the piping system. The ink volume (ink flow) delivered by the pump per unit time may be adjustable e.g. via the revolution speed of the pump depending on the type of pump. Different pressures may prevail in different sections of the piping system depending on the delivered ink flow, the flow resistance in different branches of the piping system, the number of opened ink valves, the type of ink, in particular its viscosity, the temperature, and other parameters. A pressure sensor 36 is provided just behind the drive 32 in order to be able to detect theses pressures. A positioning just behind the drive 32 has the advantage that usually the highest pressure in the piping system can be detected at that point. Alternatively or in addition to the illustrated pressure sensor 36, further pressure sensors 36 can be provided.

In order to be able to provide a desired ink level in the ink fountains 21 and to keep it as constant as possible, used-up ink in the ink fountains is refilled via the ink delivery device 30, for example. In order to determine such a demand, fill level sensors 37 are provided via which the ink level in the respective ink fountain 21 can be detected. Ink levels detected by the fill level sensors 37 can be transmitted to a control device 33. Furthermore, the ink delivery device 30 is configured such that the filling process of the ink fountains can be controlled via the control device 33. This control may take place depending on the detected fill levels. To this end, both the drive 32 and the individual ink valves 34 can be controlled by the control device 33. It is also conceivable that either only the drive 32 or the ink valves 34 are controllable. For example, instead of a control of the drive 32, a bypass valve could be provided which delivers the ink flow or part of the ink flow back into the ink container 35 if all or individual ones of the ink valves are closed.

In the illustrated preferred embodiment, both the drive 32 and the valves 34 can be controlled by the control device 33. Here, the control device 33 can be configured such that the drive can be controlled both with respect to the operating mode (on/off) and with respect to the amount of a delivered ink flow. Here, the control device 33 preferably is configured such that the ink flow can be reduced in the operation of the ink delivery device 30 if only few ink valves 34 are opened, that the ink flow can be increased if several or all valves are opened, and that the drive can be switched off if all valves are closed.

In order to keep the pressure in the system as low as possible in the operation with certain inks, which are print-sensitive, for example (e.g. UV inks), the ink delivery device 30 is preferably configured such that the drive 32 and/or the ink valves 34 can be controlled depending on the pressure or the pressures detected by the pressure sensor 36.

Such a preferred ink delivery device 30 can be operated as follows, for example.

The control device 33 detects a fill level of the ink in an ink fountain 21. If a too low ink level is detected, the drive 32 is controlled, which then starts pumping ink from the ink container 35 into the ink reservoir 31. At the same time, the ink valve 34 can be opened so that the ink is delivered to a location in the ink fountain 21, where it is required, through the ink reservoir 31 with no or a slight pressure increase.

If the ink sensor 37 detects that a desired fill level in the ink fountain 21 is reached, the control device 33 controls the drive 32 and the corresponding ink valve 34 such that the drive 32 is stopped and the ink valve 34 is closed. Here, first of all the drive 32 can be stopped and then the ink valve can be closed, so that a pressure peak is avoided. Between the closed ink valve(s) 34 and the drive 32, the ink reservoir 31 now forms a substantially closed volume in which a residual pressure exists. The residual pressure can be lowered in a further method step e.g. by reversing the drive 32, i.e. a short delivery process back into the ink container 35, or by opening one or more valves.

Furthermore, it is conceivable that, if a filling process is performed via several opened ink valves 34, the opened ink valves are closed one after the other if a desired ink level, i.e. a desired fill level, is reached in the respective region of the ink fountain 21. In this case, the method may be configured such that the delivery power of the drive 32 is reduced e.g. via a reduction of the revolution speed of the drive 32 together with the closing operation of the respective valve. Also in this case, an avoidance of unnecessary pressure peaks can be reduced or avoided in that the reduction of the delivery power takes place simultaneously with or shortly before the closing of the respective ink valve 34.

In principle, pressure peaks can particularly reliably be prevented if the ink valves 34 to be opened are opened shortly before switching on the drive or increasing the drive power of the drive 32, and in the reverse case if the ink valves 34 to be closed are closed shortly after switching off the drive 32 or decreasing the drive power thereof.

After termination of a filling process, a pressure still existing in the ink reservoir 31 can be reduced e.g. by reversing the drive 32 and/or by connecting the reservoir to a space with low pressure (e.g. the ambient pressure by opening an ink valve). Reversing of the drive 32 can be stopped if a sufficiently low pressure in the ink reservoir 31 is detected by the pressure sensor 36 and communicated to the control device 33. It is also conceivable to control the drive 33 such that a reversion by a specific amount is always performed after termination of a filling process.

Thus, in a method according to the invention, the delivery power of the ink pump or of another drive can be controlled by means of different parameters. For example, these may be the ink level in one or more ink tanks or ink fountains 21, a number of opened ink valves 34, the ink pressure and/or the operating mode of the printing machine (e.g. with which ink printing is performed).

LIST OF REFERENCE NUMERALS

10 printing machine
20 inking system
21 ink fountain
30 ink delivery device
31 ink reservoir
32 drive
33 control device
34 ink valve
35 ink container
36 pressure sensor
37 fill level sensor
38 ink delivery pipe

The invention claimed is:

1. A method for use with an ink delivery device for an ink supply of an inking system of a printing machine with ink, comprising an ink reservoir, a drive that is connected to the ink reservoir and configured such that the ink reservoir is adapted be pressurized by the drive, and a control device for controlling the drive of the ink delivery device, wherein the method comprises the following steps:

initiating an ink delivery process by opening an ink valve, increasing pressure in the ink reservoir to a target operating pressure, adjusting the pressure in the ink reservoir to an adjusted operating pressure, the step of adjusting the pressure in the ink reservoir to an adjusted operating pressure including the step of reducing the pressure in the ink reservoir to an idle pressure which is one of slightly above the level and approximately at the level of atmospheric ambient pressure, by the steps of:

switching off delivery power of the drive, leaving the ink valve open for a short period of time after the delivery power has been switched off, and then closing the respective ink valve, and terminating the ink delivery process.

2. The method according to claim 1, wherein the pressure-increasing step comprises the following steps:

detecting an actual pressure in the ink reservoir, comparing the detected actual pressure with a target operating pressure; and controlling the drive based on a comparative value between the actual pressure and the target operating pressure such that drive power of the drive is increased.

3. The method according to claim 1, wherein the method further comprises the following step:

maintaining the pressure in the ink reservoir at the target operating pressure.

4. The method according to claim 3, wherein the step of maintaining the pressure comprises the following steps:

detecting an actual pressure in the ink reservoir, comparing the detected actual pressure with the target operating pressure, controlling the ink delivery device based on a comparative value between the actual pressure and the target operating pressure such that at least one of the following occurs:

drive power of the drive is kept constant if the actual pressure corresponds to the target operating pressure, the drive power is reduced if the actual pressure exceeds the target operating pressure, and the drive power is increased if the actual pressure is below the target operating pressure.

5. The method according to claim 1, wherein the step of adjusting the pressure in the ink reservoir to an adjusted operating pressure comprises the following steps:

detecting an actual pressure in the ink reservoir, comparing the detected actual pressure with a varied target operating pressure; and controlling the ink delivery device based on a comparative value between the actual pressure and the varied target operating pressure such that drive power of the drive is reduced.

6. The method according to claim 1, wherein the step of adjusting the pressure in the ink reservoir to an adjusted operating pressure comprises the step of reducing the pressure to an idle pressure.

7. The method according to claim 6, wherein the step of adjusting the pressure to an idle pressure comprises at least one of the following additional steps after closing of the respective ink valve:

reversing a delivery direction of the ink delivery device, and opening an ink valve to achieve a pressure equalization with the ambient pressure.

8. The method according to claim 6, wherein the step of reducing the pressure to an idle pressure comprises at least one of the following additional steps after closing of the respective ink valve:

one of stopping and disengaging the drive of the ink delivery device, connecting the ink reservoir with a space in which the target idle pressure prevails, and opening an ink valve to achieve a pressure equalization with the ambient pressure.

9. The method according to claim 1, which further comprises the following steps:

detecting an actual ink level, comparing the detected actual ink level with a target ink level, and at least one of:

initiating the ink delivery process if the detected actual ink level is below the target ink level, and increasing the pressure in the ink reservoir to a target operating pressure if the detected actual ink level is below the target ink level.

10. The method according to claim 1, which further comprises the following steps:

detecting an actual ink level, comparing the detected ink level with a target ink level, and at least one of:

terminating the ink delivery process if the detected actual ink level exceeds the target ink level, and reducing the pressure in the ink reservoir to an idle pressure if the detected actual ink level exceeds the target ink level.

11. The method according to claim 1, which further comprises the following step:

determining at least one of:

the target operating pressure and the adjusted operating pressure.

12. The method according to claim 11, wherein at least one of the step of determining the target operating pressure and the step of determining the adjusted operating pressure, comprises the following steps:

detecting/determining at least one of the following values:

an ink level in an ink fountain, a type of ink used and properties thereof, a maximally admissible pressure depending on the determined type of ink used, a number of opened ink valves, a total ink flow to be delivered, and a time available for one delivery process, and calculating the target operating pressure based on at least one of the above-mentioned values.

13. The method according to claim 12, wherein the step of detecting/determining an ink level in an ink fountain includes the step of detecting different levels in different regions of an ink fountain, and the step of detecting/determining a type of ink used and the properties thereof, includes the step of determining at least one of the following characteristics of the ink used:

a) viscosity, b) printing stability and c) hardening behavior under pressure.

14. An ink delivery device for ink supply of an inking system of a printing machine with ink, comprising:

an ink reservoir, a drive that is connected to the ink reservoir and configured such that the ink reservoir is adapted to be pressurized by the drive, and a control device for controlling the drive of the ink delivery device, wherein the drive and the control device are configured and connected with each other such that the ink delivery device initiates an ink delivery process, increases pressure in the ink reservoir to a target operating pressure, adjusts the pressure in the ink reservoir to an adjusted operating pressure, and terminates the ink delivery process by opening an ink valve, and wherein the control device adjusts the pressure in the ink reservoir to an adjusted operating pressure by reducing the pressure in the ink reservoir to an idle pressure which is one of slightly above the level and approximately at the level of atmospheric ambient pressure, by:

switching off delivery power of the drive, leaving the ink valve open for a short period of time after the delivery power has been switched off, and then closing the respective ink valve.

* * * * *